US005820284A

United States Patent [19]

Owada et al.

[11] Patent Number: 5,820,284

[45] Date of Patent: Oct. 13, 1998

[54] THERMAL TRANSFER PRINTER

[75] Inventors: Isao Owada; Hiroyoshi Zama; Koichi Dobashi, all of Iwate-ken, Japan

[73] Assignee: Alps Electric Co., Ltd., Tokyo, Japan

[21] Appl. No.: 769,170

[22] Filed: Dec. 18, 1996

[30] Foreign Application Priority Data

Dec. 27, 1995 [JP] Japan ..... 7-340873

[51] Int. Cl.[6] ..... B41J 11/057

[52] U.S. Cl. ..... 400/662

[58] Field of Search ..... 400/662, 648

[56] References Cited

U.S. PATENT DOCUMENTS

| | | | |
|---|---|---|---|
| 4,725,853 | 2/1988 | Kobayashi et al. | 400/662 |
| 4,743,920 | 5/1988 | Tohma et al. | 400/662 |
| 4,780,729 | 10/1988 | Murakami et al. | 400/662 |
| 4,887,923 | 12/1989 | Ishiwaka et al. | 400/662 |
| 4,928,134 | 5/1990 | Hasegawa et al. | 400/662 |
| 4,981,381 | 1/1991 | Murata | 400/662 |

*Primary Examiner*—Edgar S. Burr
*Assistant Examiner*—Steven S. Kelley
*Attorney, Agent, or Firm*—Brinks Hofer Gilson & Lione

[57] ABSTRACT

The present invention provides a thermal transfer printer which causes neither blur in first printing nor stain on a sheet even in both-side printing, and which can securely maintain ink writing properties in recording to write an ink image by an intermediate transfer member, and re-transfer properties in re-transfer of an ink image to a printing medium over a long period time. The thermal transfer printer has an ink ribbon interposed between a thermal head having heating elements and an intermediate transfer member, a pressing member for pressing the intermediate transfer member so that an ink of said ink ribbon is transferred to the intermediate transfer member by the thermal head to form a primary recorded image, and the primary recorded image on the intermediate transfer member is transferred to a printing medium interposed between the pressing member and the intermediate transfer member by pressure of the pressing member to print a desired image, and a layer for preventing ink transfer provided on the surface of the pressing member.

10 Claims, 7 Drawing Sheets

THERMAL TRANSFER PRINTER

BACKGROUND OF THE INVENTION

1. Field of the Invention

The present invention relates to a thermal transfer printer, and particularly to a thermal transfer printer in which an ink layer of an ink ribbon is selectively melted by heat of a thermal head to transfer the ink to an intermediate transfer member, and the transferred ink is re-transferred to a recording medium to record a desired image.

2. Description of the Related Art

Conventionally, an intermediate transfer type thermal transfer printer has been known in which an ink layer of an ink ribbon is selectively melted by the heat of a thermal head to transfer the ink to an intermediate transfer member, and the transferred ink is re-transferred to a recording medium to record a desired image.

Such conventional thermal transfer printers will be described with reference to FIGS. 3 to 9.

FIGS. 3 to 6 respectively show the basic constructions of conventional examples.

The thermal transfer printer shown in FIG. 3 comprises a thermal head 1, an ink ribbon 2, an intermediate transfer roller 3 serving as an intermediate transfer member, and a drum 4 serving as a pressing member.

In the thermal head 1, in order to obtain a desired image to be printed, an ink 5 of the ink ribbon 2 is melted by the heat generated when a signal is selectively applied to many heating elements (not shown), to transfer the ink 5 to the intermediate transfer roller 3.

The intermediate transfer roller 3 also functions as a platen roller, and has the functions to temporarily hold the ink 5 selectively melted by the thermal head 1, and to re-transfer the ink to a printing sheet 6 as a printing medium wound around the drum 4.

The intermediate transfer roller 3 and the drum 4 contain heaters 7 and 8, respectively, for the purpose of heating and thermal insulation.

The surface of the intermediate transfer roller 3 is heated by the heater 7 so as to improve the performance of transfer of the ink 5 melted and transferred by the thermal head 1 to the surface of the intermediate transfer roller 5, and maintain the transferred ink 5 in a melted and softened state, as well as enabling re-transfer of the ink 5 to the printing sheet 6 by pressing the intermediate transfer roller 3 on the drum 4.

The drum 4 is heated by the other heater 8 so as to improve the performance of re-transfer of the ink 5 to the printing sheet 6 by heating and keeping the printing sheet 6 wound around the drum 4 at a predetermined temperature.

After the ink 5 first transferred to the intermediate transfer roller 3 is re-transferred to the printing sheet 6, transfer of the ink 5 to the intermediate transfer roller 3 and re-transfer of the ink 5 to the printing sheet 6 are simultaneously carried out.

Therefore, the rotational peripheral speed of the intermediate transfer roller 3 is equal to the carrying speed of the ink ribbon 2, and also substantially equal to the rotational peripheral speed of the drum 4. The transfer rate corresponding to the carrying speed of the ink ribbon 2 is thus substantially equal to the re-transfer speed corresponding to the rotational peripheral speed.

The construction of each of the parts of the thermal transfer printer shown in FIG. 3 will be described in further detail.

As the thermal head 1, a line head of 200 dpi to 600 dpi having a width of 75 to 300 mm is used. The thermal head 1 shown in FIG. 3 is a line head of 300 dpi having a width of 220 mm and a total dot number of 2560.

The intermediate transfer roller 3 preferably has a diameter of 20 mm or more, but an intermediate transfer roll having a smaller diameter can be used as long as rigidity can be ensured by using an appropriate material for a core metal. The intermediate transfer roller 3 comprises a rubber layer formed on the outer periphery of the core metal, and a transfer/re-transfer layer coated on the rubber layer. In the example shown in FIG. 3, the core metal has an outer diameter of 31 mm and an inner diameter of 28 mm, and is made of Ni-plated carbon steel. A first silicone rubber layer having a thickness of 0.5 mm is formed on the outer periphery of the core metal, and a second silicone rubber layer having a thickness of 150 $\mu$m and made of a material different from the first silicone rubber layer of 0.5 mm is further coated on the outer periphery of the first silicone rubber layer.

As the ink ribbon 2, a ribbon having the same construction as a general thermal transfer ink ribbon is used. In the example shown in FIG. 3, the ink ribbon 2 comprises a PET film having a thickness of 3.5 $\mu$m as a base film, and two ink layers formed on the base film. The lower layer of the two ink layers comprises a wax layer as a release layer having a thickness of 1 $\mu$m, and the other upper layer comprises a resin layer as an ink layer having a thickness of 1 1 $\mu$m.

As the printing sheet 6, a general printing sheet or OHP film may be used.

The drum 4 has an outer peripheral length longer than the length of the printing sheet 6 used because the printing sheet 6 is wound around the outer periphery thereof. In the example shown in FIG. 3, since the printing sheet 6 is A4 size or legal size, the drum 4 has an outer diameter of 100 mm in order to obtain the outer peripheral length of 314 mm corresponding to the total of an outer peripheral length of 300 mm for the printing sheet 6 and an outer peripheral length 14 mm for providing a damper 9 for fixing the printing sheet 6 to the drum 4.

As the heater 7 contained in the intermediate transfer roller 3, a halogen lamp with power consumption of 500 W or a cartridge heater with power consumption of 200 W can be used. As the heater contained in the drum 4, a halogen lamp with power consumption of 1 KW can be used.

The actual printing process using the printer shown in FIG. 3 will be described below.

In an initial state, the printing head 1 is moved in the direction of arrow A and brought into a stand-by state wherein the printing head 1 separates from the ink ribbon 2 which also separates from the intermediate transfer roller 3, and the drum 4 is moved in the direction of arrow B and brought into a stand-by state wherein the drum 4 also separates from the intermediate transfer roller 3.

When a power source is turned on, a current flows through the heaters 7 and 8 to start heating the intermediate transfer roller 3 and the drum 4. Further, predetermined pulses are intermittently applied to each of the heating elements of the printing head 1 to increase the temperature of the thermal head 1.

Although not shown in FIG. 3, these temperatures are detected by a thermistor, an infrared radiation temperature sensor or the like to control the temperatures by heating to a predetermined temperature and keeping the temperature. Specifically, the temperatures are controlled so that all the printing head 1, the intermediate 3, and the drum 4 are the same temperature within the range of 40° to 70° C. The temperature is more preferably controlled within the range of 50° to 60° C. In this example, all temperatures are controlled to 55° to 58° C.

The printing sheet 6 is set on the drum 4 in parallel with control of the temperatures. Although not shown in the drawings, a printing sheet feed tray is set so that printing sheets 6 are conveyed one by one from this tray. One end of the printing sheet conveyed is chucked by the damper 9 of the drum 4, and then the drum 4 is rotated to a printing operation stand-by position while winding the printing sheet 6 thereon, and then stopped.

This stand-by position is set so that a position on the intermediate transfer roller 3 where an image of a first line in a page is printed is at the first line position in the printing sheet 6 during re-transfer.

Description will now be made of the printing process after the printing operation stand-by state is completed as described above.

First the ink ribbon 2 is moved so that a predetermined color is at the printing position. In this example, a color ribbon having four colors, i.e., yellow (referred to as "Y" hereafter), magenta (referred to as "M" hereinafter), cyan (referred to as "C" hereinafter) and black (referred to as "Bk" hereinafter), is used. Since the printing order is Y→M→C→Bk, the ribbon 2 is first moved so that the front position of ink color Y is placed on the printing head. The ink colors are discriminated by a photosensor or the like (not shown) for detecting markers printed between respective colors of the ink ribbon.

In the use of a monochromatic ink ribbon (referred to as "Mk" hereinafter), since ink colors need not be discriminated, of course, pre-movement of the ink ribbon 2 is basically omitted. However, in some cases, the ink ribbon 2 is slightly pre-moved in order to remove slack of the ink ribbon 2.

Then, the thermal head 1 is pressed on the intermediate transfer roller 3 with the ink ribbon 2 therebetween while moving in the direction of arrow C. At the same time, the drum 4 is pressed on the intermediate transfer roller 3 while moving in the direction of arrow D.

At this time, the pressure of the thermal head 1 is 100 to 300 g/cm$^2$, and, in this example, the pressure is 200 g/cm$^2$.

The pressure of the drum 4 is 1 to 10 Kg/cm$^2$, and, in this example, the pressure is 5 Kg/cm$^2$.

After pressing is completed, the intermediate transfer roller 3 is rotated by a motor, which is not shown in the drawings, and, at the same time, the ink ribbon 2 is moved by the frictional force between the intermediate transfer roller 3 and the ink ribbon 2. The drum 4 is also rotated by the frictional force between the drum 4 and the intermediate roller 3 with the printing sheet 6 therebetween, or the frictional force generated directly from the drum 4.

The ink ribbon 2 is separately independently wound by a motor, which is not shown in the drawings, during the printing operation. This winding speed is always set to be higher than the carrying speed generated by the frictional force between the intermediate transfer roller 3 and the ink ribbon 2, and a difference between both speeds is canceled by a slipping mechanism of a winding unit so as to maintain a state wherein the ink ribbon 2 is always tensioned without slacking after transfer.

Predetermined printing pulses are applied to the heating elements of the thermal head 1 in parallel with the rotation of each of the parts, and the ink 5 of the ink ribbon 2 is melted and transferred by virtue of the heat generated from each of the heating elements in accordance with the printing signal.

The melted and transferred ink 5 is further rotated while maintaining a melted or semi-melted state on the intermediate transfer roller 3 by virtue of the heat of the intermediate transfer roller 3.

The ink 5 in a melted or semi-melted state is re-transferred to the printing sheet 6 held between the intermediate transfer roller 4 and the drum 4 by the contact therebetween under pressure, and the heating and insulation effect of the intermediate transfer roller 3 and the drum 4.

In this example, M, C and Bk colors are continuously printed in contact under pressure between the intermediate transfer roller 3 and the drum 4 and between the intermediate transfer roller 3 and the thermal head 1 with the ink ribbon 2 therebetween, without releasing these contact states.

This is because the length of a ribbon of each of the colors is defined so that the front end of a color ink ribbon of a next color of M, C or Bk is automatically put at the position of the thermal head 1 after printing of the Y color is completed. As a result, each time printing of each of the colors is completed, it is unnecessary to release pressure of the thermal head 1, release pressure of the drum 4, and pre-move the ink ribbon 2 to set the ink front position. This makes it possible to continuously repeat transfer of the ink 5 to the intermediate transfer roller 3 and re-transfer of the ink 5 to the printing sheet 6 for the four colors while applying pulses based on printing information of each color to the thermal head 1.

After printing of the colors Y, M, C and Bk is completed, the thermal head 1 and the drum 4 are moved in the direction of arrow A and the direction of arrow B, respectively, to release pressure.

After pressure is released, the printing sheet 6 on which printing is completed is separated from the drum 4, and discharged.

The printing process in the thermal transfer printer shown in FIG. 3 has been described above.

Although, in the example shown in FIG. 3, the four colors are continuously printed, printing can also be carried out by a process in which the operation comprising detecting the front position of each color of the ink ribbon, bringing the intermediate transfer roller 3 into contact under pressure with the thermal head 1 and the intermediate transfer roller 3 into contact under pressure with the drum 4, printing (re-transfer), and releasing each pressure is interposed between the printing operations for the respective colors, as in a conventional printer.

In this example, in assumption of color printing, the fed printing sheet 6 is chucked by the damper 9 of the drum 4 for winding and fixing the sheet 6. However, in monochromatic printing with, for example, Mk ink, the printing sheet 6 may be discharged at the same time as re-transfer, and thus the printing sheet 6 must not always be chucked.

The thermal transfer printer shown in FIG. 4 will be described below.

The basic printing principle is the same as that shown in FIG. 3, but the printer shown in FIG. 4 differs from the printer shown in FIG. 3 in the point that an intermediate transfer belt 10 is provided in place of the intermediate transfer roller 3 shown in FIG. 3. The intermediate transfer belt 10 is wound around a platen roller 11 and a pressure roller 12 so as to be rotated while being tensioned by both rollers 11 and 12.

The intermediate transfer belt 10 is preferably a seamless belt, but a belt with a seam can be used while avoiding transfer and re-transfer of the ink 5 at the seam position.

In the example shown in FIG. 4, a polyimide seamless belt having a thickness of 50 μm is used as the intermediate transfer belt 10. On the seamless belt is coated a transfer/re-transfer coating rubber layer having a thickness of 150 μm.

The platen roller 11 and the pressure roller 12 independently function, i.e., the platen roller 11 functions to transfer the ink 5 to the intermediate transfer belt 10, and the other pressure roller 12 functions to re-transfer the ink 5 to the printing sheet 6. These rollers 11 and 12 are heated by built-in heaters 13 and 14, respectively, to temperatures suitable for the functions.

In further detail, in the example shown in FIG. 4, the platen roller 11 comprises a core metal made of an aluminum material and having an outer diameter of 16 mm, and a silicone rubber layer having a thickness of 1 mm and provided on the outer periphery of the core metal. In the platen roller 11 is provided a halogen lamp with power consumption of 200 W as the heater 13 so as to control the surface temperature of the intermediate transfer belt 10 wound around the platen roller 11 to 40° C.

The pressure roller 12 used comprises a core metal made of an aluminum material and having an outer diameter of 42 mm, and a silicone rubber layer having a thickness of 0.5 mm and provided on the outer periphery of the core metal. In the pressure roller 12 is provided a halogen lamp with power consumption of 200 W as the heater 14 so as to control the surface temperature of the intermediate transfer belt 10 wound around the platen roller 12 to 65° C.

As described above, in the example shown in FIG. 4, the transfer unit and the re-transfer unit are independently provided so that the temperatures of these units can be independently controlled under optimum conditions.

The thermal transfer printer shown in FIG. 5 will be described below.

The basic printing principle is the same as that shown in FIG. 3, but the printer shown in FIG. 5 differs from the printer shown in FIG. 3 in the point that a pressure roller 15 is provided in place of the drum 4 shown in FIG. 3. In re-transfer to the printing sheet 6, the pressure roller 15 is pressed on the intermediate transfer roller 3 to heat only a contact portion of the printing sheet 6.

Unlike the drum 4, the pressure roller 15 of the example shown in FIG. 5 has no function to wind the printing sheet 6 and thus has no effect of heating and thermally insulating the entirety of the printing sheet 6.

In the printing process, unlike the printer shown in FIG. 3, the four colors cannot continuously be printed at a time, but the four colors are printed by a swing back system in which, after one color is printed, the process comprising releasing pressure of the thermal head 1, pre-moving the ink ribbon 2 for setting the front position of a next color of the ink ribbon 2 or tensioning the ink ribbon 2, and reversely moving the printing sheet 6 to the initial stand-by position is performed before next printing.

The thermal transfer printer shown in FIG. 6 will be described below.

The example shown in FIG. 6 is an example in which the examples shown in FIGS. 4 and 5 are combined, and the pressure roller 15 shown in FIG. 5 is used while using the intermediate transfer belt 10 shown in FIG. 4 to perform the swing back system of printing process.

Although, in each of the examples shown in FIGS. 3 to 6, printing is performed on only one side of the printing sheet 6, printing on both sides of the printing sheet 6, i.e., the face and back sides thereof, can be achieved by repeating twice the process of each of the examples.

Various means are considered as means for carrying the printing sheet 6 in both-side printing. Typical examples of such means will be described below with reference to FIGS. 7 to 9.

FIG. 7 shows an example of means for carrying the printing sheet in both-side printing.

In the example shown in FIG. 7, after printing sheets 6 subjected to printing on the faces thereof are discharged, the printing sheets are again set face down in a feeding tray 16, to achieve printing on the both sides.

In principle, the example shown in FIG. 8 is the same as the example shown in FIG. 7 except that the work of the user is partially simplified.

Namely, printing sheets 6 subjected to printing on the faces thereof are stored in a discharge stacker 17. Since the discharge stacker 17 is detachably formed as the paper feeding tray 16, the discharge stacker 17 is mounted upside down as the feeding tray 16 so that the printing sheets 6 are fed for performing printing on the back side thereof, to achieve printing on both sides.

FIG. 9 shows an example in which the printing sheet 6 is carried for both-side printing within the printer apparatus.

Namely, the printing sheet 6 subjected to printing on the face thereof is not discharged, but the sheet 6 is passed through a carrying route 18 and temporarily stored in a storage stacker 19 within the printer apparatus, and the printing sheet 6 is then carried to a printing portion from the storage stacker 19 through a carrying route 20 so as to print on the back side. After printing is performed on the back side, the printing sheet 6 is discharged to the discharge stacker 17 through a discharge route 21.

However, in the above-mentioned both-side printing, when a second printing (on the back side) is re-transferred after first printing (on the face) is completed, the ink 5 printed on the first printing peels off and adheres to the drum 4 or the pressure roller 15 opposite to the intermediate transfer roller 3, thereby blurring the first printed portion, or the ink 5 adhering to the drum 4 or the pressure roller 15 is transferred to a printing sheet 6 for next printing, and thus causes the problem of staining the sheet.

Furthermore, the conventional intermediate transfer members 3 and 10 have the problem that writing properties with the ink 5 during recording of an ink image, and the re-transfer properties during re-transfer of an ink image to the printing sheet 6 can not sufficiently be maintained over a long period of time.

SUMMARY OF THE INVENTION

An object of the present invention is to provide a thermal transfer printer which causes neither blur in first printing nor stain on a sheet even in both-side printing, and which can securely maintain the writing properties of ink in recording to write an ink image by an intermediate transfer member, and re-transfer properties in re-transfer of an ink image to a printing medium over a long period of time.

In order to achieve the object, in accordance with an aspect of the present invention, there is provided a thermal transfer printer comprising a layer for preventing transfer of an ink, which is provided on only a pressing member or both the pressing member and the intermediate transfer member.

In accordance with another aspect of the present invention, there is provided a thermal transfer printer comprising a silicone rubber or fluororesin coating layer provided as a layer for preventing transfer of an ink.

In accordance with a further aspect of the present invention, there is provided a thermal transfer printer comprising a silicone rubber layer containing (a) alkenyl group-containing organopolysiloxane, (b) organohydrodienepolysiloxane, (c) non-reactive organopolysiloxane represented by the following formula (1):

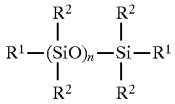

(1)

[wherein $R^1$ is a monovalent hydrocarbon group having no aliphatic unsaturated group or a hydroxyl group; and $R^2$ is a methyl group or a phenyl group, and may be the same or different groups, the ratio of phenyl groups to all $R^2$ groups in each molecule being 1 to 30 mol %], (d) hydrosilylation catalyst, and no inorganic filler.

DESCRIPTION OF THE PREFERRED EMBODIMENTS

Figure 1:
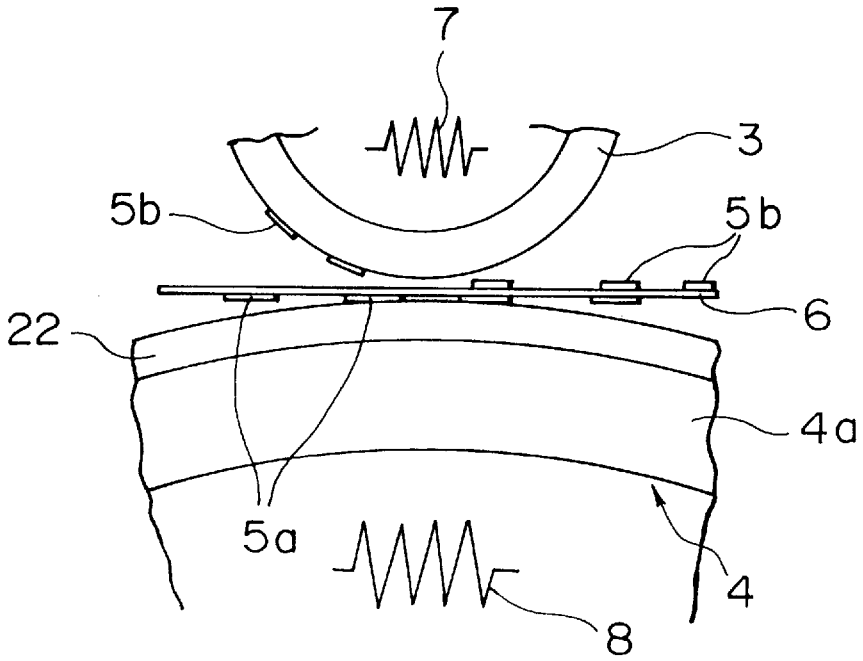
FIG. 1 is an enlarged view illustrating a principal portion of a thermal transfer printer in accordance with an embodiment of the present invention.

FIG. 1 illustrates the vicinity of a drum in second printing (on the back side) after first printing (on the face) is completed in accordance with an embodiment of the present invention.

In this embodiment, a layer 22 for preventing transfer of an ink is formed on the outer peripheral surface of a core metal 4*a* of a drum 4 serving as a pressure member. This layer 22 for preventing transfer of an ink is formed by coating silicone rubber. The layer 22 for preventing transfer of an ink preferably has a thickness of 100 μm or less, and, in this embodiment, the layer 22 has a thickness of 20 to 40 μm. The silicone rubber preferably has rubber hardness of 15 to 50 (JIS A).

In this embodiment, the silicone rubber contains no inorganic filler and is formed by blending and curing the following components:

(a) Alkenyl group-containing organopolysiloxane 100 parts by weight of dimethylpolysiloxane sealed with dimethylvinylsilyl group at both terminals thereof, and a viscosity of 400 cps at 25° C.

(b) Organohydrodienepolysiloxane 2.2 parts by weight of organohydrodienepolysiloxane represented by the following average formula (2):

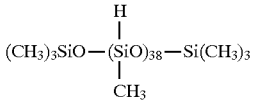

(2)

(c) Non-reactive organopolysiloxane 1.0 parts by weight of methylphenylpolysiloxane as non-reactive organopolysiloxane having a viscosity of 2000 cps at 25° C., and terminals sealed with trimethylsilyl groups, containing 6 mol % of diphenylsiloxane units and represented by the above formula (1):

(d) Hydrosilylation catalyst 0.5 part by weight of 2 wt % alcohol solution of chloroplatinic acid.

The organohydrodienepolysiloxane (b) may be a compound represented by the following formula (3):

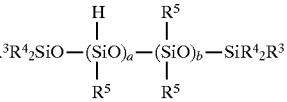

(3)

[wherein $R^3$ indicates a hydrogen atom or a monovalent hydrocarbon group having no aliphatic unsaturated group, $R^4$ and $R^5$ each indicate a monovalent hydrocarbon group having no aliphatic unsaturated group and may be the same or different from each other, a is an integer of at least 3, b is an integer of 0 or more, and the ratio a/(a+b) is 0.7 to 1.0.]

The alkenyl group-containing organopolysiloxane (a) used in the present invention, for example, has the unit structural formula, $R^6R^7SiO$, wherein each of $R^6$ and $R^7$ is an alkyl group such as methyl, ethyl, propyl or the like, in which the hydrogen atoms combined with the carbon atoms may be partly or entirely substituted by fluorine atoms, as 3,3,3-trifluoropropyl group; an alkenyl group having 2 to 3 carbon atoms, such as vinyl, allyl or the like; and a terminal group is a vinyl group, a trimethylsilyl group or the like. The alkenyl group-containing organopolysiloxane (a) generally has a viscosity of 100 to 100000 cps at 25° C., and preferably has at least two alkenyl groups per molecule.

The organohydrodienepolysiloxane (b) used in the present invention functions as a crosslinking agent for the alkenyl group-containing organopolysiloxane (a), and expressed by the formula (3).

In the formula (3), $R^3$ is a hydrogen atom or a monovalent hydrocarbon group having no aliphatic unsaturated group. Examples of such monovalent hydrocarbon groups include alkyl groups such as methyl, ethyl, propyl and the like, in which the hydrogen atoms combined with the carbon atoms may be partly or entirely substituted by fluorine atoms, as 3,3,3-trifluoropropyl group. A hydrogen atom or a methyl group is particularly preferable as $R^3$.

In the formula (3), $R^4$ and $R^5$ are each a monovalent hydrocarbon group having no aliphatic unsaturated group. Examples of such hydrocarbon groups include the same groups as $R^3$, and a methyl group is particularly preferable.

In order to form a desired transfer layer by crosslinking components (b) and (a), in the formula (3), a is an integer of 3 or more, and b is an integer of 0 or more. In order to improve the adhesion between a constituent material of the surface layer of the transfer layer and a lower intermediate transfer elastic layer, and to sufficiently exhibit the effect of improving the releasability from an ink, the crosslink density must be increased, and the ratio a/a+b is preferably 0.7 to 1.0.

The organohydrodienepolysiloxane (a) preferably has a viscosity of 1000 cps or less at 25° C. The number of the hydrogen atoms combined with silicon atoms in the organohydrodienepolysiloxane is preferably at least one, and more preferably 1 to 5, per alkenyl group in the alkenyl group-containing organopolysiloxane (a).

In the present invention, the non-reactive organopolysiloxane (c) is a component characteristic of the present invention, and significantly contributes to improvement in the releasability of the layer 22 for preventing transfer of an ink with respect to the ink 5.

The component (c) is represented by the formula (1). In the formula (1), examples of monovalent hydrocarbon groups having no aliphatic unsaturated group indicated by $R^1$ include the same groups as $R^4$ and $R^5$ in the formula (2), and a methyl group is preferable. $R^2$ is a methyl group or a phenyl group, and may be the same or different groups. It is necessary that the non-reactive organopolysiloxane (c) contains phenyl groups in a ratio of 1 to 30 mol %, preferably 3 to 15 mol %, to the all $R^2$ groups in each molecule. With a content of phenyl groups of less than 1 mol %, the compatibility with the alkenyl group-containing organopolysiloxane (a) of the base polymer is increased, and thus the component (c) is easily captured in the base polymer, thereby making the component (c) difficult to bleed on the surface layer of the transfer layer to form a uniform release layer.

With a content of phenyl groups of over 30 mol %, the compatibility with the alkenyl group-containing organopolysiloxane (a) of the base polymer is excessively low, and thus the component (c) excessively bleeds on the surface layer of the transfer layer, thereby causing problems in that the writing properties deteriorate, a uniform release layer cannot be formed, and the release properties cannot be stably maintained over a long period of time due to large changes in the release properties with time. Hence, when the content of phenyl groups is 1 to 30 mol %, it is possible to prevent excessive bleeding of the releasing agent, always form a uniform release layer and obtain the sufficient release properties with respect to initial properties and durability.

The non-reactive organopolysiloxane (c) preferably has a viscosity of 100 to 100000 cps at 25° C., and more preferably 300 to 10000 cps at 25° C., in order to obtain good release properties.

The amount of the component (c) added is preferably 0.2 to 10.0 parts by weight, and more preferably 0.5 to 3.0 parts by weight, based on 100 parts by weight of component (a).

In the present invention, the hydrosilylation catalyst is a catalyst for accelerating addition reaction between components (a) and (b). A platinum group metal catalyst generally well known by persons skilled in the art, such as a platinum type, palladium type or rhodium type catalyst, is used, and a platinum type catalyst is preferably used. Examples of such platinum type catalysts include platinum black, chloroplatinic acid, complexes of chloroplatinic acid and olefin such as ethylene, alcohol, aldehydes, vinylsilane or vinylsiloxane or the like.

The amount of the hydrosilylation catalyst (d) added is generally 1 to 50 ppm, and preferably 5 to 20 ppm, in terms of a platinum group metal based on 100 parts by weight of component (a).

The operation of this embodiment will be described below.

FIG. 1 shows the state wherein second printing (printing on the back side) is carried out, and the ink 5*b* transferred to the intermediate transfer roller 3 is re-transferred to the back side of the printing sheet 6. At this time, re-transfer is performed under conditions in which both the surface temperature of the intermediate transfer roller 3 and the surface temperature of the drum 4 are controlled to 55° C., and the transfer roller 3 and the drum 4 apply a pressure of 5 $Kg/cm^2$ to the printing sheet 6 held therebetween.

If printing is performed on the back side by the conventional example under the conditions of the above temperature and pressure, the ink 5*a* first printed on the printing sheet 6 is transferred to the surface of the drum 4. In this embodiment of the present invention, however, since the layer 22 for preventing transfer of an ink is formed on the surface of the drum 4, the ink 5*a* is not transferred to the drum 4, thereby preventing the occurrence of blur in a print, and stains on a sheet in next printing.

Figure 2:
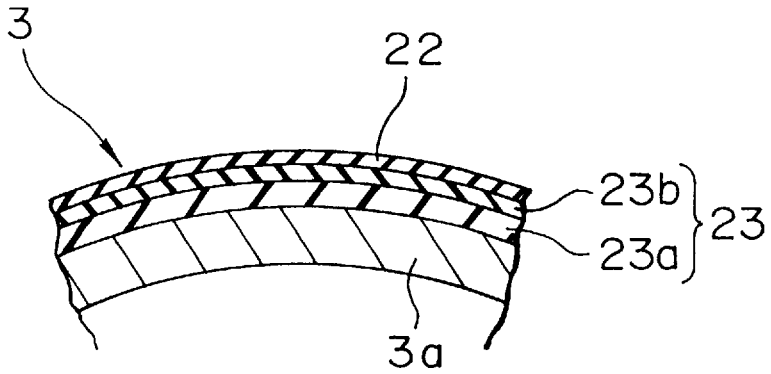
FIG. 2 is an enlarged view illustrating a principal portion of an intermediate transfer roller of a thermal transfer printer in accordance with an embodiment of the present invention.

In addition, when the layer 22 for preventing transfer of an ink, which comprises the silicone rubber, is formed on the surface of the intermediate transfer roller 3 under the same conditions as described above, as shown in FIG. 2, the ink wiring properties during recording to write an ink image by the intermediate transfer roller 3, and the re-transfer properties in re-transfer of the ink image to the printing sheet 6 can securely be maintained over a long period of time, and high-quality printing can be made on the printing sheet 6 such as plain paper, bond paper or the like.

In this case, it is optimum to form as an intermediate elastic layer 23 an elastic layer comprising a first layer 23*a* and a second layer 23*b* formed in turn on the outer periphery of the core metal 3*a* between the core metal 3*a* of the intermediate transfer roller 3 and the layer 22 for preventing ink transfer.

The first layer 23*a* of the intermediate elastic layer 23 is capable of improving the adhesion between the intermediate transfer roller 3 and the thermal head 1, and stably transferring the ink 5 to the intermediate transfer roller 3, as well as improving the uniformity of load in re-transfer and the re-transfer ability. The first layer 23*a* preferably has a thickness of 0.1 to 2.8 mm and comprises an elastic material having rubber hardness of 15 to 70 (JIS A). Particularly, the first layer 23*a* preferably has a thickness of 1 mm and comprises silicone rubber with rubber hardness of 30 (JIS A).

The second layer 23*b* of the intermediate elastic layer 23 is formed on the outer periphery of the first layer 23*a* of the intermediate elastic layer 23, and is capable of improving the smoothness of the layer 22 for preventing ink transfer, follow-up properties with respect to unevenness of the printing sheet 6 and printing quality. The second layer 23*b* preferably has a thickness of 5 to 200 $\mu$m and comprises an elastic material having rubber hardness of 10 to 35 (JIS A). Particularly, the second layer 23*b* preferably has a thickness of 100 $\mu$m and comprises silicone rubber having rubber hardness of 25 (JIS A) and containing no inorganic filler.

Figure 3:
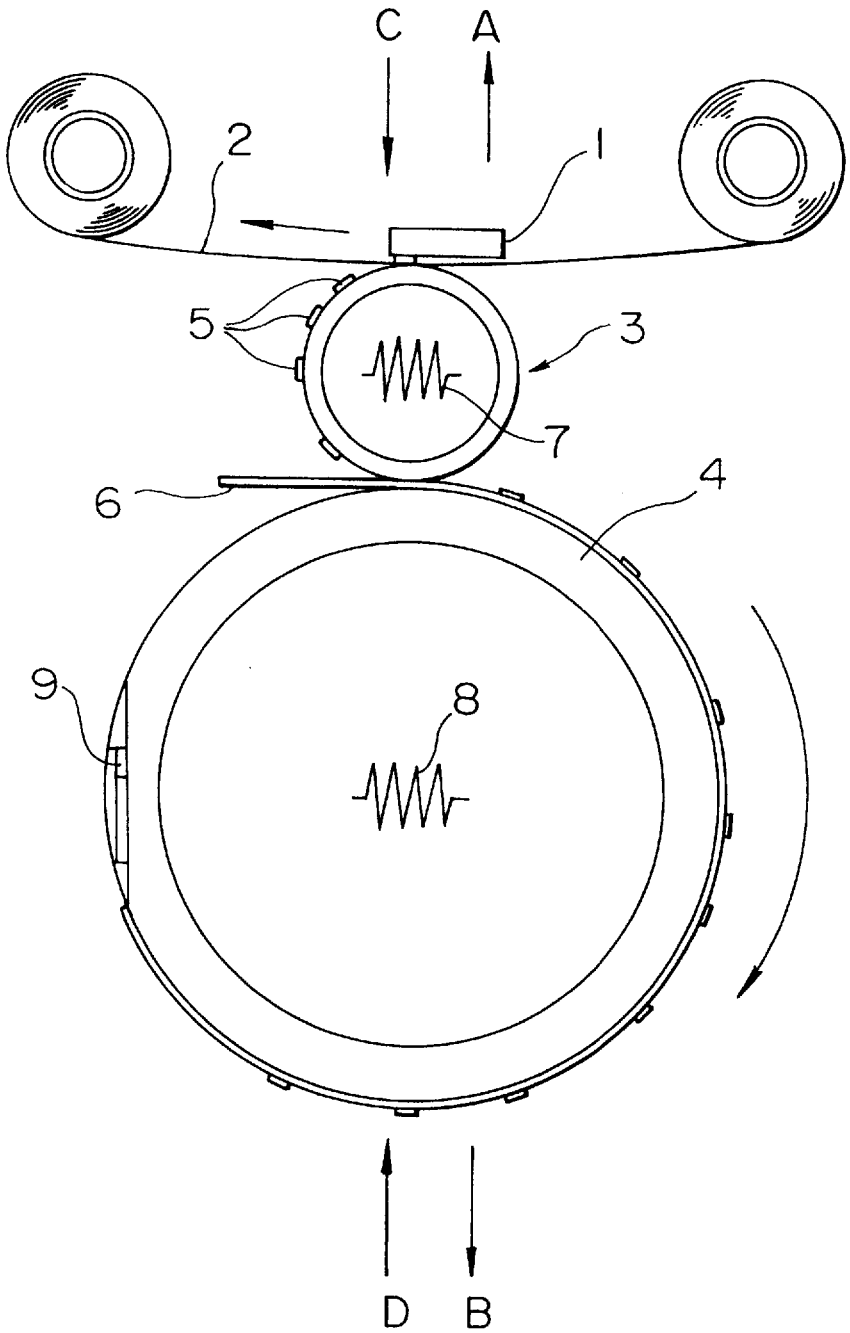
FIG. 3 is a block diagram illustrating an example of conventional thermal transfer printers.
Figure 4:
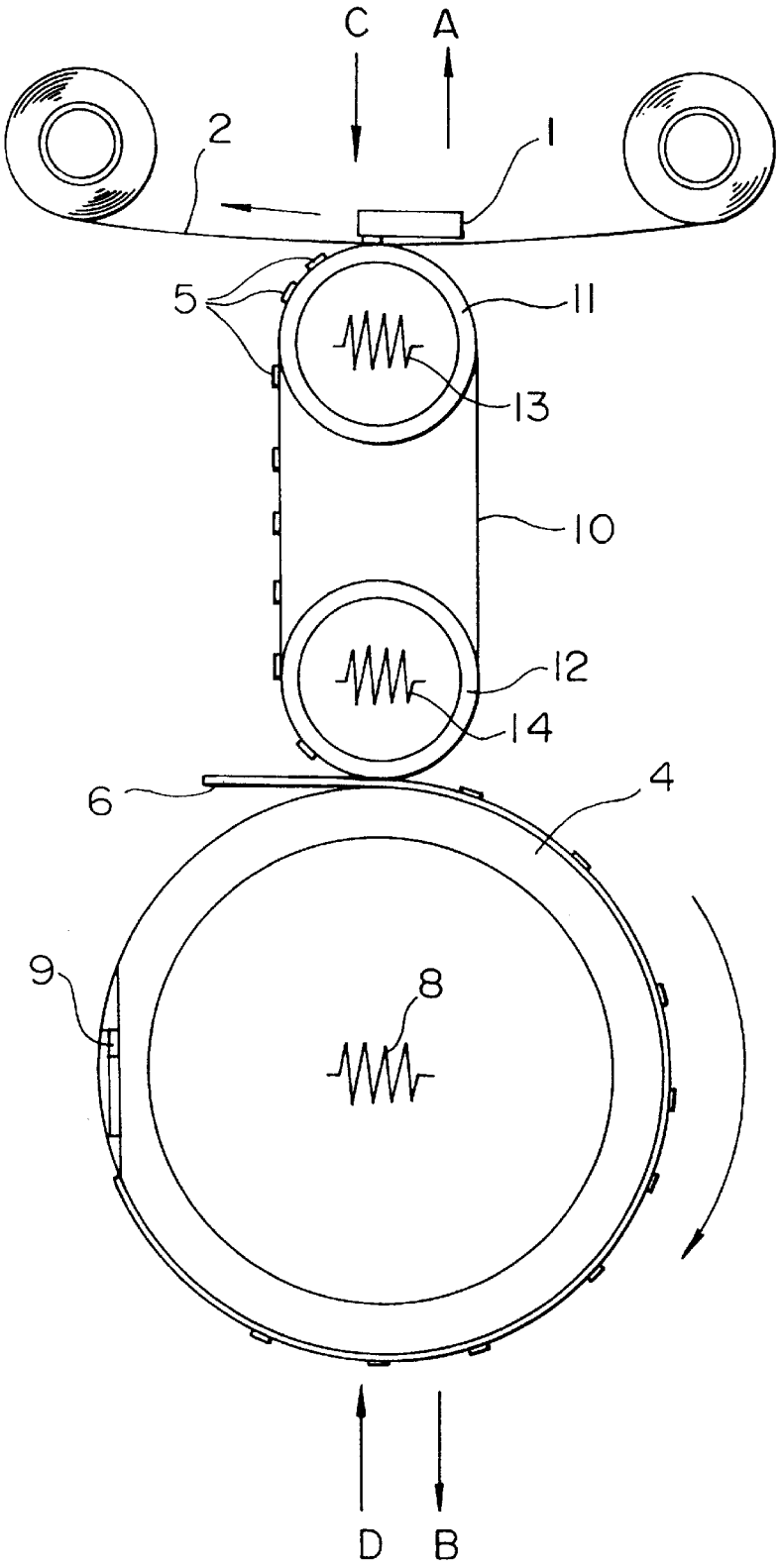
FIG. 4 is a block diagram illustrating another example of conventional thermal transfer printers.
Figure 5:
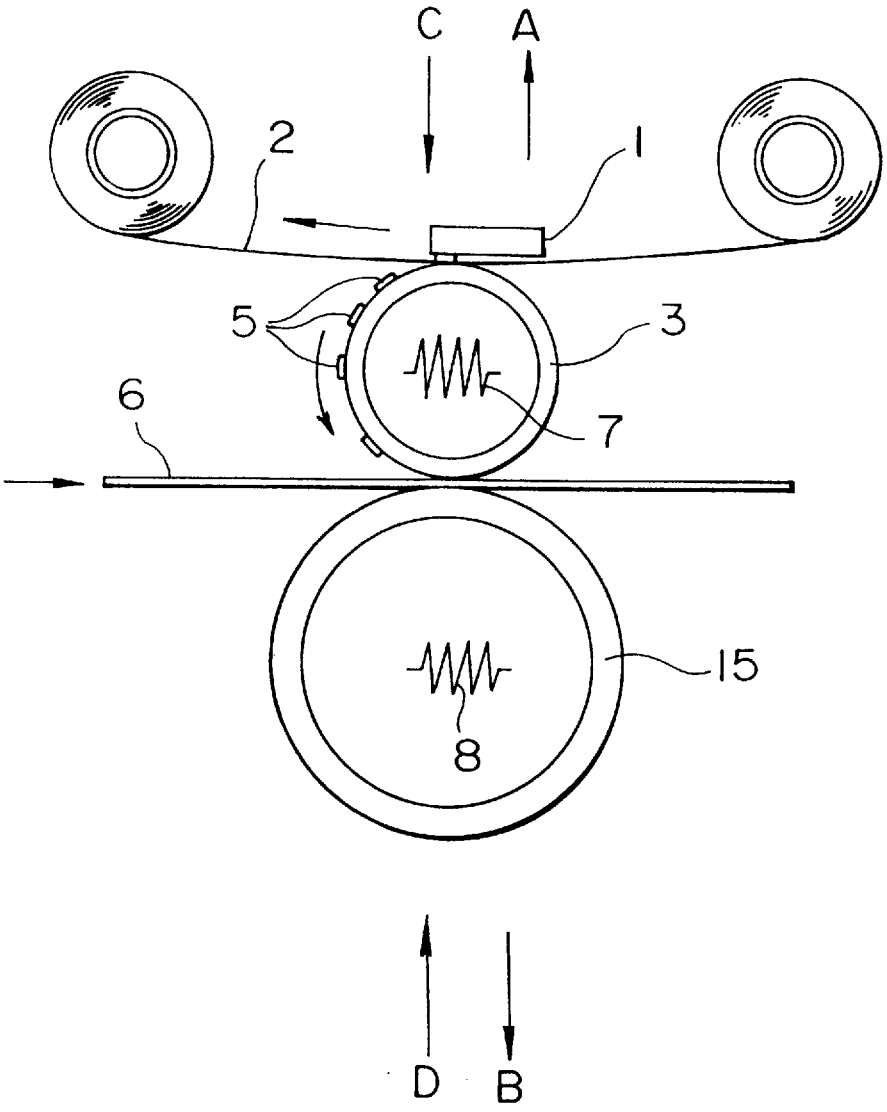
FIG. 5 is a block diagram illustrating still another example of conventional thermal transfer printers.
Figure 6:
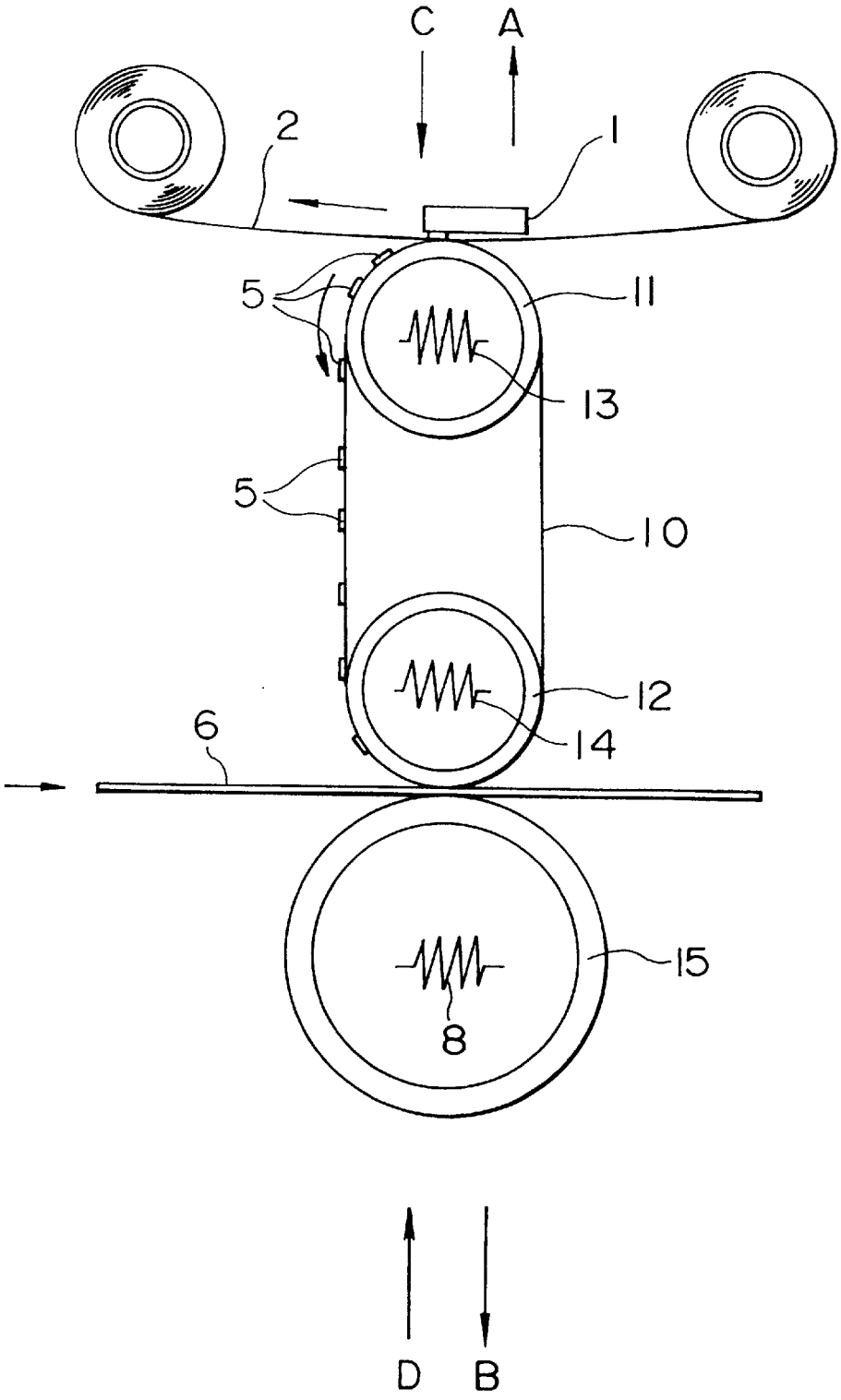
FIG. 6 is a block diagram illustrating a further example of conventional thermal transfer printers.
Figure 7:
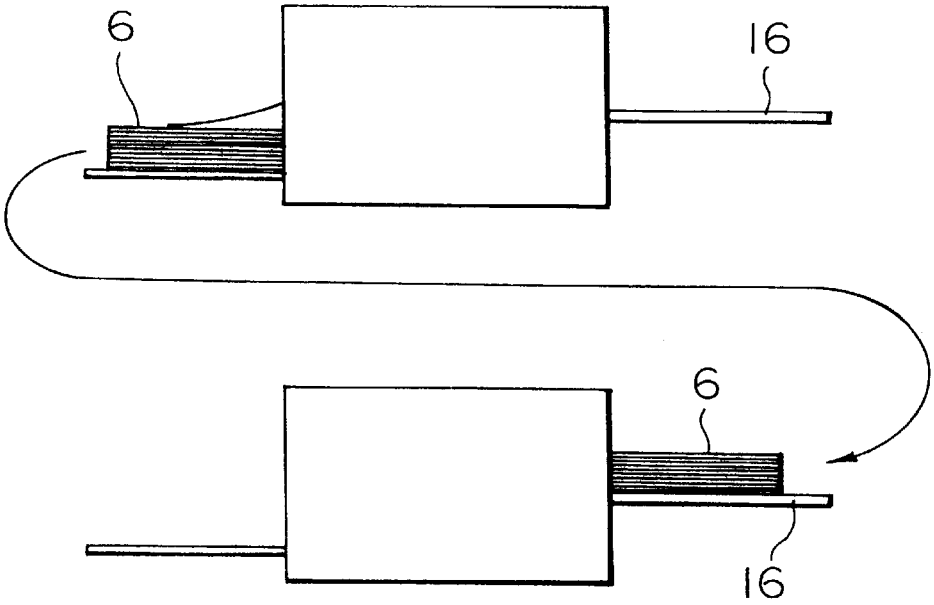
FIG. 7 is a block diagram illustrating an example of conventional both-side printing.
Figure 8:
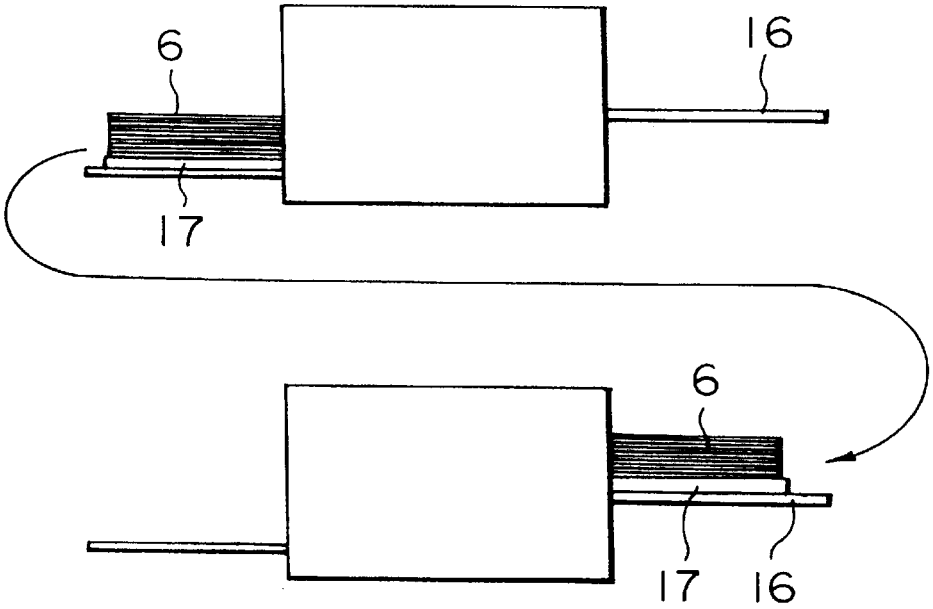
FIG. 8 is a block diagram illustrating another example of conventional both-side printing.
Figure 9:
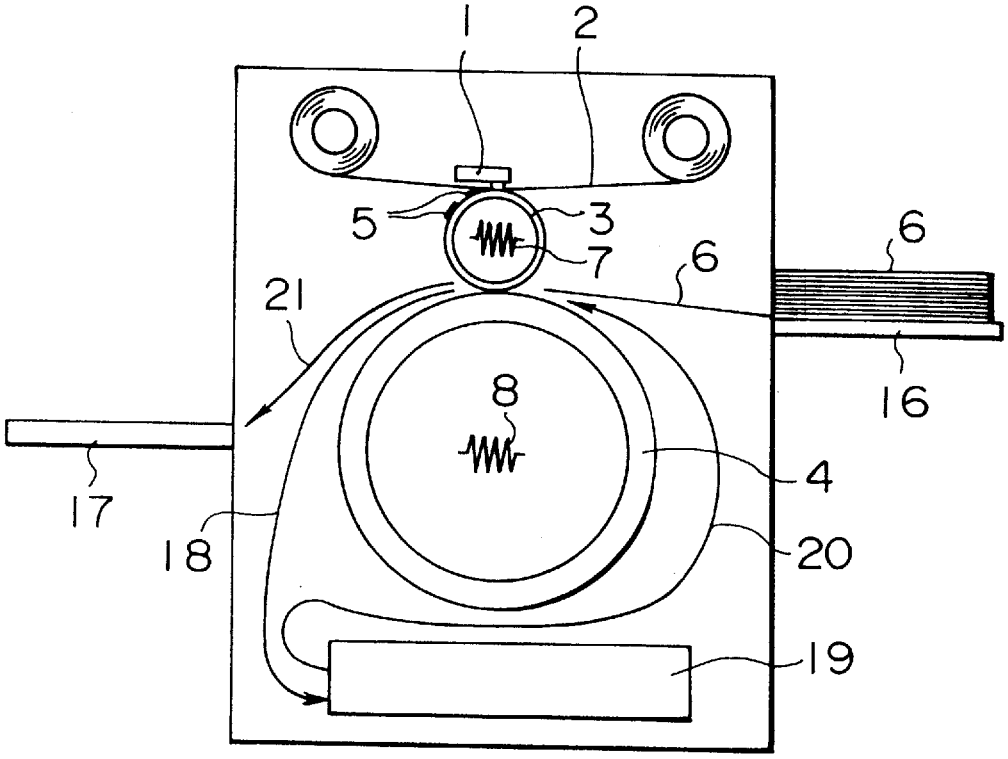
FIG. 9 is a block diagram illustrating a further example of conventional both-side printing.

The embodiment shown in FIG. 1 relates to a thermal transfer printer having a construction corresponding to FIG. 3. However, the present invention can also be applied to the thermal transfer printers having the constructions shown in FIGS. 4 to 6.

When the layer 22 for preventing ink transfer is formed by coating a fluororesin such as tetrafluoroethylene resin or the like, a coated layer having a thickness of 20 $\mu$m or less exhibits the same excellent effects as the layer comprising the silicone rubber. Particularly, with a thickness of 8 to 12 $\mu$m, the effects are further improved.

The thermal transfer printer constructed as described above causes neither blur in first printing nor stain on a printing sheet even in both-side printing, and has the effect of maintaining the ink writing properties in recording to write an ink image by an intermediate transfer member, and the re-transfer properties in re-transfer of an ink image to a recording medium over a long period of time.

What is claimed is:

1. A thermal transfer printer comprising an ink ribbon interposed between a thermal head having a heating element and an intermediate transfer member, and a pressing member for pressing the intermediate transfer member so that an ink of said ink ribbon is transferred to the intermediate transfer member by the thermal head to form a primary recorded image, and the primary recorded image on the intermediate transfer member is transferred to a printing medium interposed between the pressing member and the intermediate transfer member by pressure of the pressing member to print a desired image, and a layer for preventing ink transfer is provided on a surface of the pressing member, wherein said layer comprises a silicone rubber or fluororesin coating and said silicone rubber coating, containing no inorganic fillers, comprises:

a) alkenyl group-containing organopolysiloxane;

b) organohydrodienepolysiloxane;

c) non-reactive organopolysiloxane represented by the following formula:

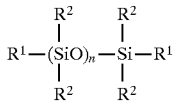

wherein $R^1$ is a monovalent hydrocarbon group having no aliphatic unsaturated group or a hydroxyl group; and $R^2$ is selected from a group consisting of a methyl group or a phenyl group, and may be the same or different groups, the ratio of phenyl groups to all $R^2$ groups in each molecule being 1–30 mol %; and d) hydrosilylation catalyst.

2. A thermal transfer printer according to claim 1, wherein said silicone rubber coating has a thickness of 100 μm or less.

3. A thermal transfer printer according to claim 1, wherein said fluororesin coating has a thickness of 20 μm or less.

4. The thermal transfer printer of claim 1, wherein said organohydrodienepolysiloxane comprises the following formula:

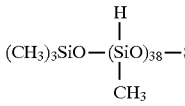

5. The thermal transfer printer of claim 1, wherein said organohydrodienepolysiloxane comprises the following formula:

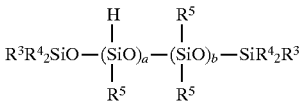

wherein $R^3$ is selected from a group consisting of a hydrogen atom or a monovalent hydrocarbon group having no aliphatic unsaturated group, $R^4$ and $R^5$ are selected from said monovalent hydrocarbon group having no aliphatic unsaturated group, and may be the same or different from each other, a is an integer of at least 3, b is an integer of at least 0, such that the ratio of a/(a+b) is 0.7 to 1.0.

6. A thermal transfer printer comprising an ink ribbon interposed between a thermal head having a heating element and an intermediate transfer member, and a pressing member for pressing the intermediate transfer member so that an ink of said ink ribbon is transferred to the intermediate transfer member by the thermal head to form a primary recorded image, and the primary recorded image on the intermediate transfer member is transferred to a printing medium interposed between the pressing member and the intermediate transfer member by pressure of the pressing member to print a desired image, and a layer for preventing ink transfer is provided on a surface of the intermediate transfer member, wherein said layer comprises a silicone rubber or fluororesin coating and said silicone rubber coating, containing no inorganic fillers, comprises:

a) alkenyl group-containing organopolysiloxane;

b) organohydrodienepolysiloxane;

c) non-reactive organopolysiloxane represented by the following formula:

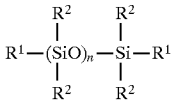

wherein $R^1$ is a monovalent hydrocarbon group having no aliphatic unsaturated group or a hydroxyl group; and $R^2$ is selected from a group consisting of a methyl group or a phenyl group, and may be the same or different groups, the ratio of phenyl groups to all $R^2$ groups in each molecule being 1–30 mol %; and d) hydrosilylation catalyst.

7. A thermal transfer printer according to claim 6, wherein said silicone rubber coating has a thickness of 100 μm or less.

8. A thermal transfer printer according to claim 6, wherein said fluororesin coating has a thickness of 20 μm or less.

9. The thermal transfer printer of claim 6, wherein said organohydrodienepolysiloxane comprises the following formula:

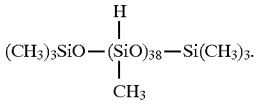

10. The thermal transfer printer of claim 6, wherein said organohydrodienepolysiloxane comprises the following formula:

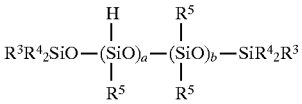

wherein $R^3$ is selected from a group consisting of a hydrogen atom or a monovalent hydrocarbon group having no aliphatic unsaturated group, $R^4$ and $R^5$ are selected from said monovalent hydrocarbon group having no aliphatic unsaturated group, and may be the same or different from each other, a is an integer of at least 3, b is an integer of at least 0, such that the ratio of a/(a+b) is 0.7 to 1.0.

* * * * *